US005909972A

United States Patent [19]

Kotoh

[11] Patent Number: 5,909,972

[45] Date of Patent: Jun. 8, 1999

[54] BRAILLE FORMING APPARATUS FOR FORMING WIDE PATTERNS AND LINES

[75] Inventor: Hirotoshi Kotoh, Yokohama, Japan

[73] Assignee: Ricoh Company, Ltd., Tokyo, Japan

[21] Appl. No.: 08/893,229

[22] Filed: Jul. 15, 1997

[30] Foreign Application Priority Data

Jul. 19, 1996 [JP] Japan ..... 8-209299

[51] Int. Cl.[6] ..... B41J 3/32

[52] U.S. Cl. ..... 400/109.1; 400/130

[58] Field of Search ..... 101/3.1, 18; 400/109, 400/109.1, 127, 130, 131, 129; 434/113–117

[56] References Cited

U.S. PATENT DOCUMENTS 3,197,889 8/1965 Micropoulou ..... 434/113
3,363,339 1/1968 Place ..... 434/113
4,261,663 4/1981 Grimnes ..... 101/18
5,449,240 9/1995 Dorpfeld et al. ..... 101/3.1
5,574,830 11/1996 Quzilleau ..... 434/113
5,767,764 6/1998 Ida ..... 434/113

*Primary Examiner*—Ren Yan
*Attorney, Agent, or Firm*—Oblon, Spivak, McClelland, Maier & Neustadt, P.C.

[57] ABSTRACT

A braille forming apparatus which can properly form a large pattern and a wide line. A large pattern can be formed by an initial closed loop pattern, followed by forming a further pattern within the original closed loop pattern. A wide line can be formed by repeating this operation, or by utilizing specialized patterns in which a pen tip of the braille forming apparatus is not required to be lifted off of the braille sheet.

24 Claims, 7 Drawing Sheets

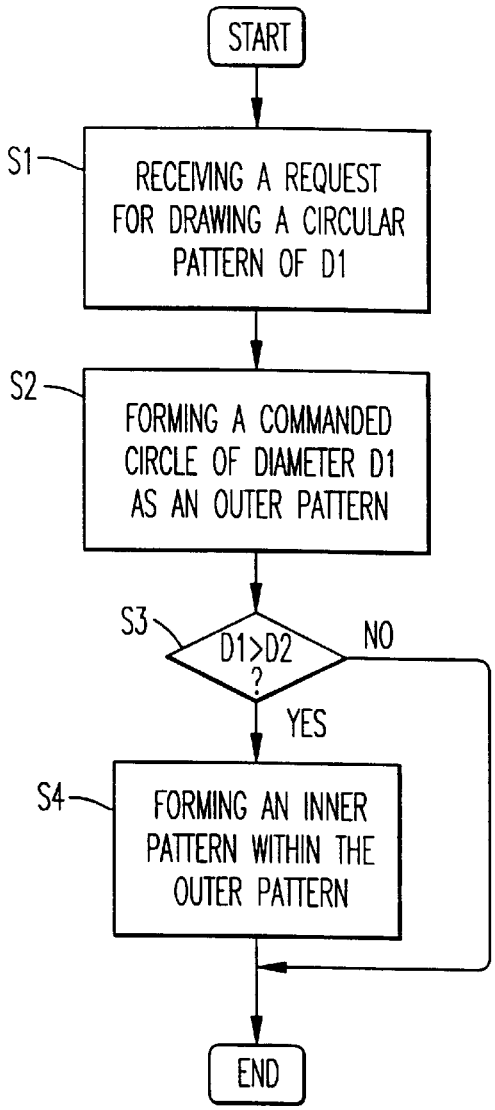
*FIG. 3A*
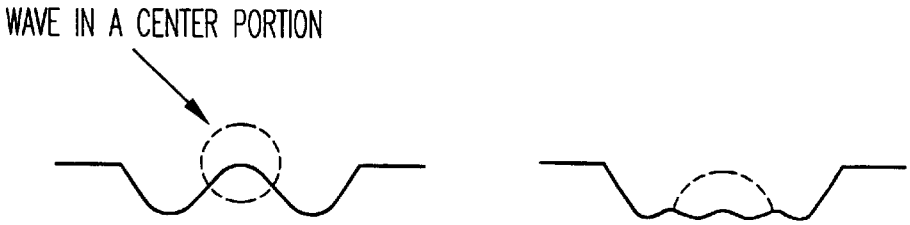
*FIG. 4A* *FIG. 4B*

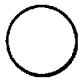
FIG. 9A
BACKGROUND ART
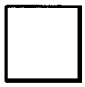
FIG. 9B
BACKGROUND ART
FIG. 10A
BACKGROUND ART
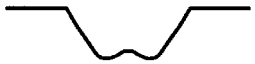
REGULAR SIZE DOT
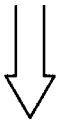
WAVE IN A CENTER PORTION
FIG. 10B
BACKGROUND ART
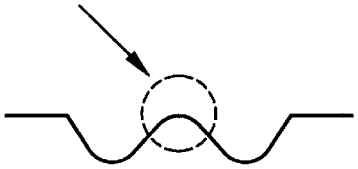
LARGE SIZE DOT
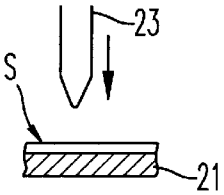
FIG. 11A
BACKGROUND ART
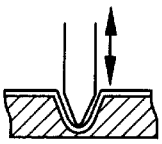
FIG. 11B
BACKGROUND ART
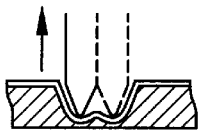
FIG. 11C
BACKGROUND ART
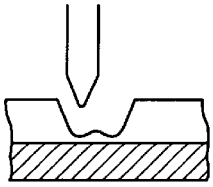
FIG. 11D
BACKGROUND ART
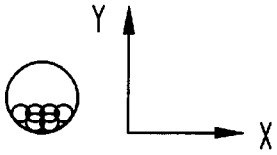
FIG. 11E
BACKGROUND ART

BRAILLE FORMING APPARATUS FOR FORMING WIDE PATTERNS AND LINES

BACKGROUND OF THE INVENTION

1. Field of the Invention

The present invention is directed to a braille forming apparatus for forming a braille pattern on a braille sheet, and more particularly, the present invention is directed to a braille pattern forming apparatus which effectively forms a large pattern or a wide line pattern.

2. Discussion of the Background Art

In a background braille pattern forming apparatus, a braille sheet which is thick and which is made of a special material is set on a rubber platen and a pen tip which is hard and stick shaped presses against the braille sheet to form a braille pattern thereon. This operation results in forming a convex braille pattern on a platen side of the braille sheet.

In a background braille forming apparatus, it may be desirable to form a large pattern on the braille sheet, such as a large dot as shown in FIG. 9(*a*) or a large square pattern as shown in FIG. 9(*b*). In a background braille forming apparatus, such a large pattern is formed by placing the pen tip against the braille sheet and by moving the pen tip in a pattern corresponding to an outline of the desired pattern. For example, if the large dot as shown in FIG. 9(*a*) is desired to be formed on a braille sheet, in a background braille forming apparatus a pen tip contacts the braille sheet and moves in a circular closed loop pattern. If the large square pattern of FIG. 9(*b*) is desired to be formed on a braille sheet, the pen tip contacts the braille sheet and moves in a square closed loop pattern.

With such a background braille forming apparatus, if the large size pattern formed by moving the pen tip in the closed loop is of a reasonably large size, a braille pattern as shown in FIG. 10(*a*) is formed. However, if a very large size dot pattern as shown in FIG. 9(*a*) or a very large square pattern as shown in FIG. 9(*b*) is desired to be formed, a drawback occurs that a wave is formed in the center portion of such patterns, as shown in FIG. 10(*b*). That is, if a very large pattern is desired to be formed with the background braille forming apparatus as discussed above, as the pen tip in the background braille forming apparatus proceeds through its closed loop pattern, such a closed loop pattern does not extend to a very center portion of such a closed loop pattern, and as a result a wave is formed in the center portion of the closed loop pattern as shown in FIG. 10(*b*).

An operation of a further background braille forming apparatus to form a large size pattern is shown in FIG. 11. In such a further system, a large size braille pattern is formed by repeatedly moving a pen tip through a predetermined pattern in an X-Y direction, corresponding to the surface of the braille sheet.

More particularly, in the operation of this further background braille forming apparatus as shown in FIG. 11, a pen tip 23 of a braille writing apparatus is lowered towards a sheet S placed on a platen 21, as shown in FIG. 11(*a*). Then, as shown in FIG. 11(*b*), such a pen tip 23 contacts the sheet S on the platen 21 to form a convex point, which is a concavity from a view point of the platen 21. Then, as shown in FIG. 11(*c*), the pen tip 23 is moved in an X direction as it contacts the sheet S. The pen tip 23 is then lifted up from the paper sheet S as shown in FIG. 11(*d*). Then, in this background braille forming apparatus the pen tip 23 is displaced slightly in a Y direction and then the pen tip 23 again contacts the paper sheet S and repeats the steps as shown in FIGS. 11(*a*)–11(*d*). This results in the pen tip 23 forming a pattern as shown in FIG. 11(*e*). With this operation, a large pattern can be formed by repeatedly moving the pen tip 23 in predetermined directions.

The drawbacks with such a system as shown in FIG. 11 is that the pen tip 23 is repeatedly lifted up and down and repeatedly collides with the platen 21. This results in a problem that noise is formed in the system by the repeated collisions between the pen tip 23 and the platen 21. Moreover, such a system is slow by requiring a great amount of time in forming the pattern as a result of the repeated movements and lifting up and down of the pen tip 23.

Moreover, in the background braille apparatus as discussed above, when a wide line is desired to be formed, such a wide line is formed as a series of dots which repeat the motions as discussed above.

More specifically, if a wide line is desired to be formed in the system discussed with reference to FIGS. 9 and 10, such a wide line is formed of a series of dots, in which each individual dot is formed by moving the pen tip 23 in the closed loop pattern. If a wide line is desired to be formed in the system discussed with reference to FIG. 11, such a wide line is formed as a series of dots, each individual dot being formed by the operation shown in FIGS. 11(*a*)–11(*e*). Such background systems of forming a wide line suffer from the same defects as discussed above in that a wave may appear in the center portion of each dot, as in the system discussed with reference to FIG. 10, and such a system may be very slow and create noise, as in the system discussed with reference to FIG. 11.

SUMMARY OF THE INVENTION

Accordingly, one object of this invention is to provide a novel braille forming apparatus which overcomes the drawbacks in the background braille forming apparatus as discussed above.

A more specific object of the present invention is to provide a novel braille forming apparatus which can completely form a large size pattern at a high speed.

The novel braille forming apparatus of the present invention achieves such objects by forming a large pattern as a series of concentric closed loop patterns. The present invention also achieves such objects by forming a wide line from a continuous pattern, and not as a series of individual dot patterns.

BRIEF DESCRIPTION OF THE DRAWINGS

A more complete appreciation of the present invention and many of the attendant advantages thereof will become readily obtained as the same becomes better understood by reference to the following detailed description when considered in connection with the accompanying drawings, wherein:

FIGS. 4(*a*) and 4(*b*) further explain the control operations of FIGS. 3(*a*)–3(*c*);

FIGS. 9(*a*) and 9(*b*) show background braille patterns;

FIGS. 10(*a*) and 10(*b*) show an operation in a background braille forming apparatus; and FIGS. 11(*a*)–11(*e*) show an operation in a further background braille image forming apparatus.

DESCRIPTION OF THE PREFERRED EMBODIMENT

Figure 1:
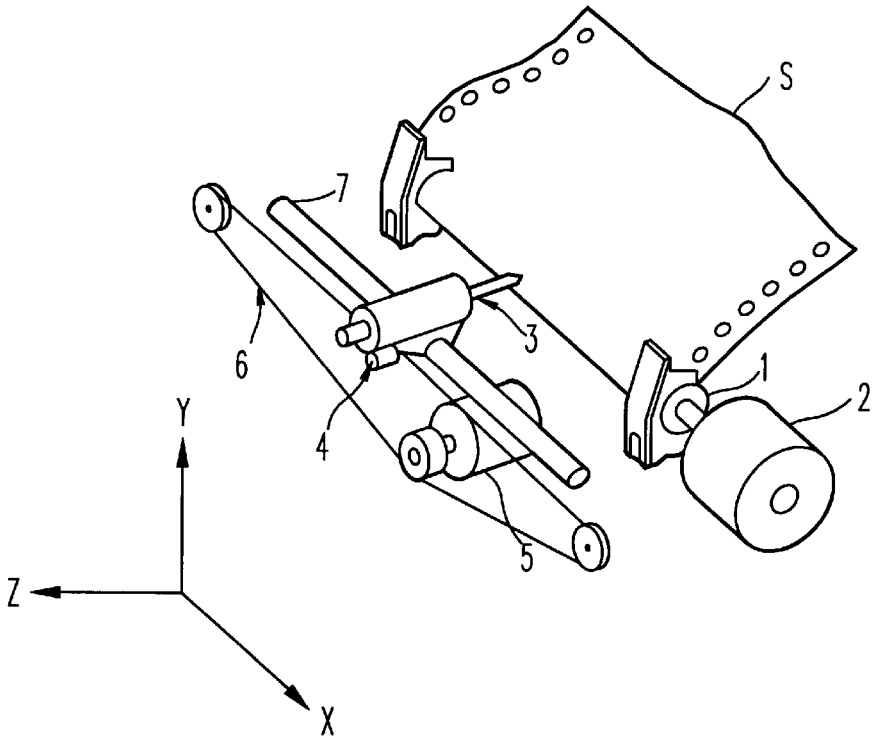
FIG. 1 shows a braille forming apparatus according to the present invention.

Referring now to the drawings, wherein like reference numerals designate identical or corresponding parts throughout the several views, and more particularly to FIG. 1 thereof, main portions of a braille forming apparatus according to the present invention are shown.

A braille forming apparatus as in the present invention as shown in FIG. 1 is provided with a platen 1 having a surface formed of a low hardness member, such as rubber. A first pulse motor 2 rotates the platen 1 in forward and reverse directions. A braille forming pen 3 of a high hardness forms a convex braille pattern onto a braille sheet S placed on the platen 1. A magnet 4 drives the pen 3 into the braille sheet S. A second pulse motor 5 moves a braille forming device composed of the pen 3, the magnet 4 for driving the pen, a wire 6 and a shaft 7 supporting the pen 3.

Figure 2:
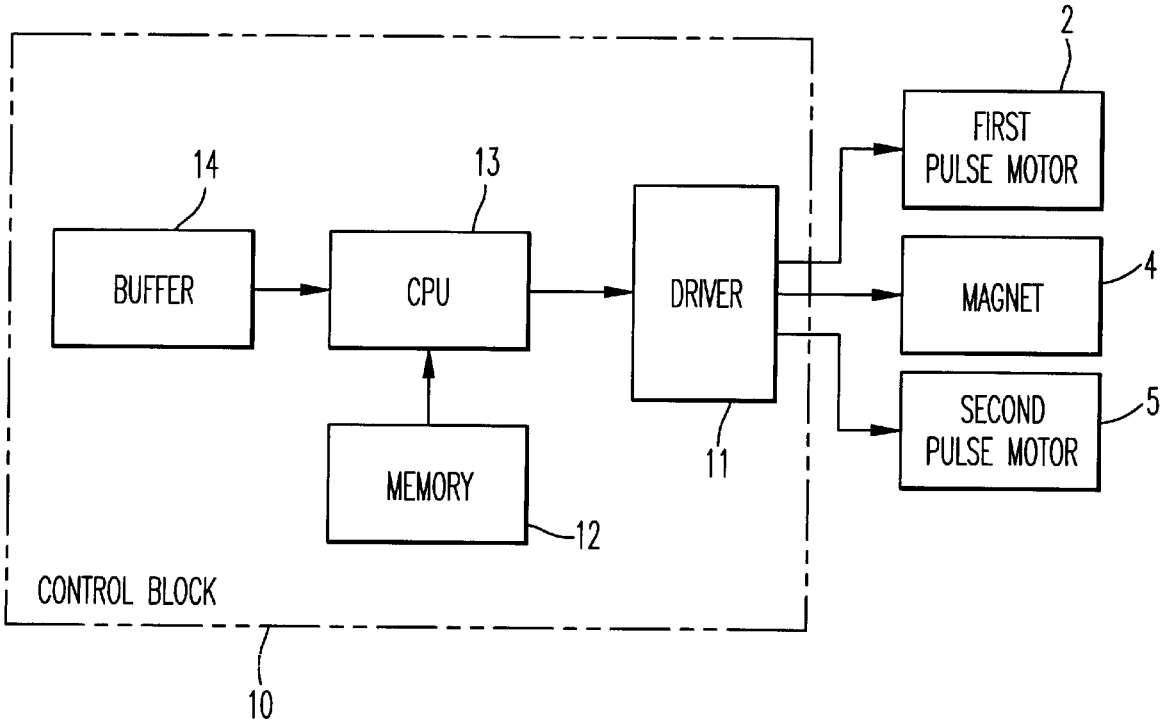
FIG. 2 shows a further description of the braille forming apparatus of the present invention.

FIG. 2 shows a block diagram of the braille forming apparatus of FIG. 1 which includes a control block 10. The control block 10 includes a driver 11 which drives the first pulse motor 2, the second pulse motor 5 and the magnet 4 for driving the pen 3. The control block 10 further includes a CPU 13 which controls the driver 11 in accordance with software stored in a memory 12 and input signals input to a buffer 14.

In the braille forming apparatus of the present invention, driving signals provided to the first pulse motor 2 from the driver 11 control rotation of the platen 1, and thereby control moving the braille sheet S in forward and reverse directions. The pen 3 presses against the sheet S by an operation of the magnet 4, to thereby drive the pen 3 into the braille sheet S to form the braille patterns on the sheet S. Further, the pen 3 moves in a direction along the shaft 7 when driving signals provided to the second pulse motor 5 move wire 6. The signals output from driver 11 are controlled by CPU 13, and CPU 13 operates in accordance with a program stored in memory 12.

With such an operation in the present invention, relative movements in each of X, Y directions between the pen 3 and the sheet S are achieved, and thereby a desired braille pattern can be formed on the sheet S.

As noted above, one of the drawbacks with the background braille forming apparatus is than when a large pattern is to be formed, a wave portion may appear in the center thereof, see FIG. 10(*b*). One control operation of the present invention, which can be implemented as software stored in the memory 12, is to overcome this drawback. With this operation of the present invention, assume that a large circle pattern as shown in FIG. 9(*a*) having a diameter D1 is to be formed on a braille sheet S. The shape of such a braille pattern as a circle is provided only as an example, and clearly other shapes of braille patterns can be implemented by the same operation as will now be discussed with reference to FIGS. 3(*a*)–3(*c*).

Information for drawing different braille patterns based on input data is stored in the memory 12, and CPU 13 sequentially receives information for drawing a braille pattern and executes forming a braille pattern on the sheet S based on information stored in the memory 12.

Figure 3B:
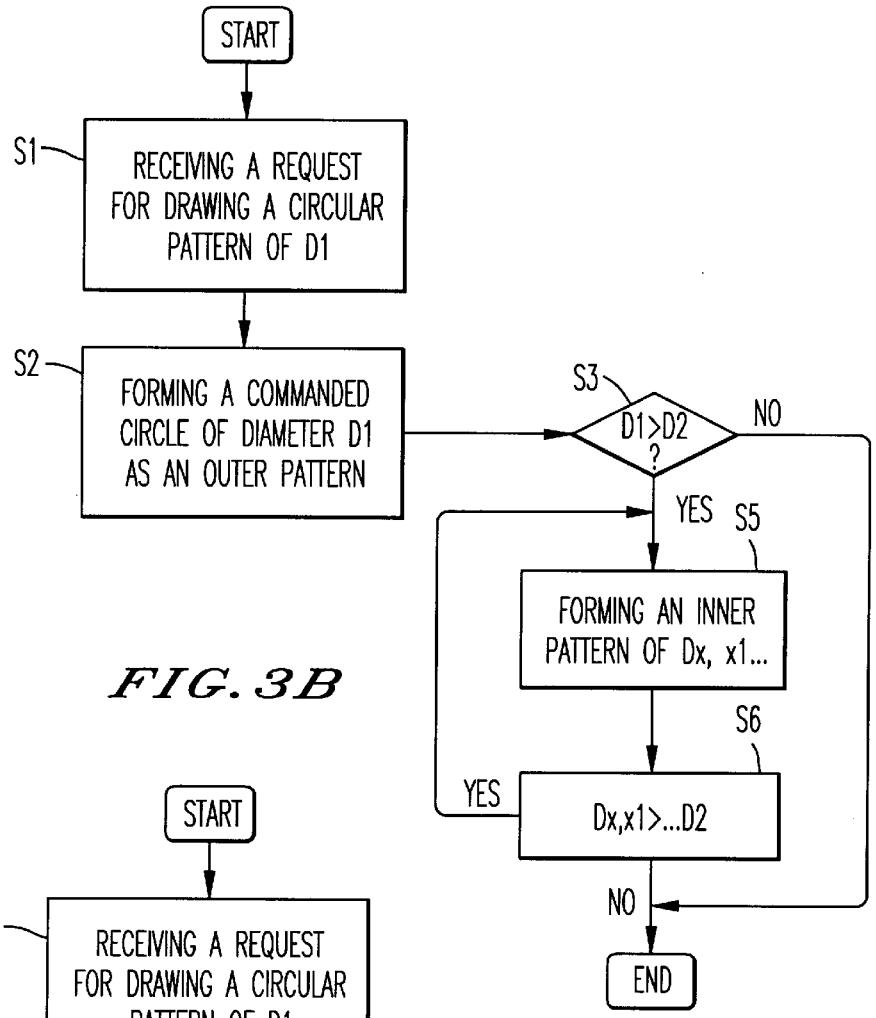
FIGS. 3(*a*)–3(*c*) show control operations in the braille forming apparatus of the present invention.
Figure 3C:
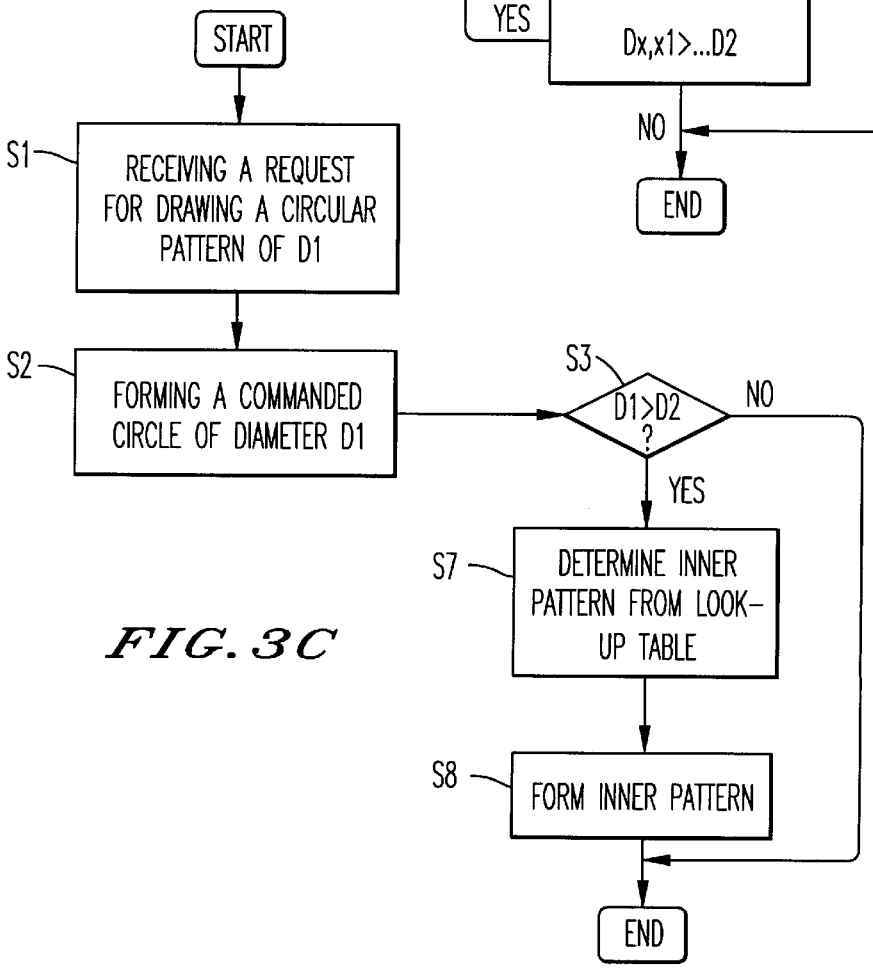

In the operation of the present invention as shown in FIG. 3(*a*), in a step S1 the CPU 13 receives a request for drawing a circular pattern on a braille sheet S. This information includes information as to a diameter D1 of the circular pattern and a relative position of a center of the circular pattern. Then, in a step S2, based on software provided in the memory 12, the CPJ 13 determines a position where the pen 3 is to press against the braille sheet S to form the requested circular pattern. The CPU 13 thereby provides driver 11 with control signals to control a movement of the pen 3, and the driver 11 provides the second pulse motor 5 with a pulse signal corresponding to a required amount of movement of the pen 3 in the X direction, and driver 11 provides the first pulse motor 3 with a pulse signal corresponding to a required amount of movement of the platen 1 holding the braille sheet S in a Y direction. As noted above, the pen 3 moves in a horizontal direction X while the sheet S moves in a vertical direction Y direction.

As shown in step S3, the CPU 13 then performs an operation to determine whether the input diameter D1 of the requested circular pattern exceeds a reference value D2. This reference value D2 corresponds to a diameter of a circular pattern which results in a wave being formed in a center portion thereof, as shown in FIG. 4(*a*). As one concrete example, if a thickness of the pen 3 is 0.5 mm, and the pen 3 is moved in a closed loop pattern to form a large circular pattern, the pen 3 can form a large circular dot pattern of about 1 mm without forming the center wave portion as shown in FIG. 4(*a*). However, when the diameter of the requested circular pattern exceeds 1.0 mm, a wave portion will start to be formed in the center of the formed circular pattern, as shown in FIG. 4(*a*). This reference value D2 thereby corresponds to a size of a pattern which results in a wave being formed in the center thereof, as shown in FIG. 4(*a*).

If the result of step S3 is NO, indicating that the diameter of the requested circular patterns is less than the reference value D2 stored in the memory 13, then the braille forming apparatus of the present invention forms the circular pattern by a conventional technique by moving the pen 3 in a closed loop, similarly as discussed above with respect to FIGS. 9 and 10.

However, if the result of step S3 is YES, indicating that the requested circular pattern to be drawn has a larger diameter than that of the reference value D2 stored in memory 12, then the CPU 13 controls driver 11 to perform an operation in which two closed loop patterns are formed one inside of the other. More particularly, if the result of step S3 is a YES, the system of the present invention proceeds to initially form a closed loop pattern corresponding to the diameter D1 as shown in FIG. 4(*a*). This operation is the same as the background art disclosed in FIG. 10(*b*). However, the present invention then provides a further operation to lift the pen 3 off of the braille sheet S, and to then form another inner pattern inside of the original loop pattern, to thereby eliminate the wave portion. As one specific example, the system of the present invention controls the pen 3 to form another circular closed loop pattern within the original circular closed loop pattern having the diameter D1. This results in eliminating the wave portion as shown in FIG. 4(*b*).

In this operation as discussed above, it may be typical to form the inner pattern outside of the original outer pattern as a same shape as the original outer pattern. However, the inner pattern could have a different shape. Moreover, this operation can be repeated if the pattern desired to be formed on the braille sheet S is exceedingly large. That is, in the example provided above, two inner circular closed loop patterns could be formed inside of the original circular closed loop pattern of diameter D1 if required to eliminate the wave portion.

The control operation in the braille forming apparatus of the present invention as discussed above with respect to FIG. 3(*a*) is directed to forming a single inner pattern within an outer pattern. However, this control operation could be modified if a very large pattern is requested to be drawn.

With reference to FIG. 3(*b*), a further control operation of the present invention is shown which includes steps S1–S3 as shown in FIG. 3(*a*). In this further control operation of FIG. 3(*b*), after it is determined whether the diameter of D1 of the requested circular pattern exceeds the referenced value D2, a first inner pattern of diameter Dx is formed in step S5. The diameter of this first inner of Dx is then compared with the reference value D2 in step S6. If the value Dx is smaller than the reference value D2, the operation is ended. However, if this value Dx is greater than the reference value D2, i.e., YES in step S6, the operation proceeds to form another inner pattern of diameter Dx−1 in step S5. With this operation of the present invention, a plurality of inner patterns can be formed within the outer pattern until a wave is eliminated. This operation of the present invention is effective if a very large pattern is requested to be formed.

A further control operation can be implemented as shown in FIG. 3(*c*). This operation as shown in FIG. 3(*c*) again also includes the same steps S1–S3 as in FIG. 3(*a*). With this further control operation of the braille forming apparatus of the present invention, after the step S3 if the diameter of D1 of the requested circular pattern is determined to be greater than the reference value D2, i.e., YES in step of S3, in step S7 a look-up table is referenced to determine the type of inner pattern (for example the number of inner patterns or the shape of the inner pattern) to be formed. That is, with this operation of the present invention a look-up table can be referenced which indicates an appropriate inner pattern which fills in an outer pattern with the requested diameter of D1. The determined inner pattern may include forming a plurality of closed loop patterns, to achieve a similar operation as for example in FIG. 3(*b*), although other inner loop patterns can be selected. After the step S7, the determined inner loop pattern is formed in step S8, and then the operation is ended.

Moreover, if a wide line is desired to be formed, these operations of the present invention as in FIGS. 3(*a*)–3(*c*) can be repeated for a series of circular patterns which extend to form a wide line. However, one drawback with forming a wide line by such a series of circular patterns is that the pen 3 is repeatedly lifted up from and down to the braille sheet S.

A further feature of the present invention is to provide further operations in which a wide line can be formed, without requiring a constant lifting of the pen 3 from the braille sheet S.

Figure 5:
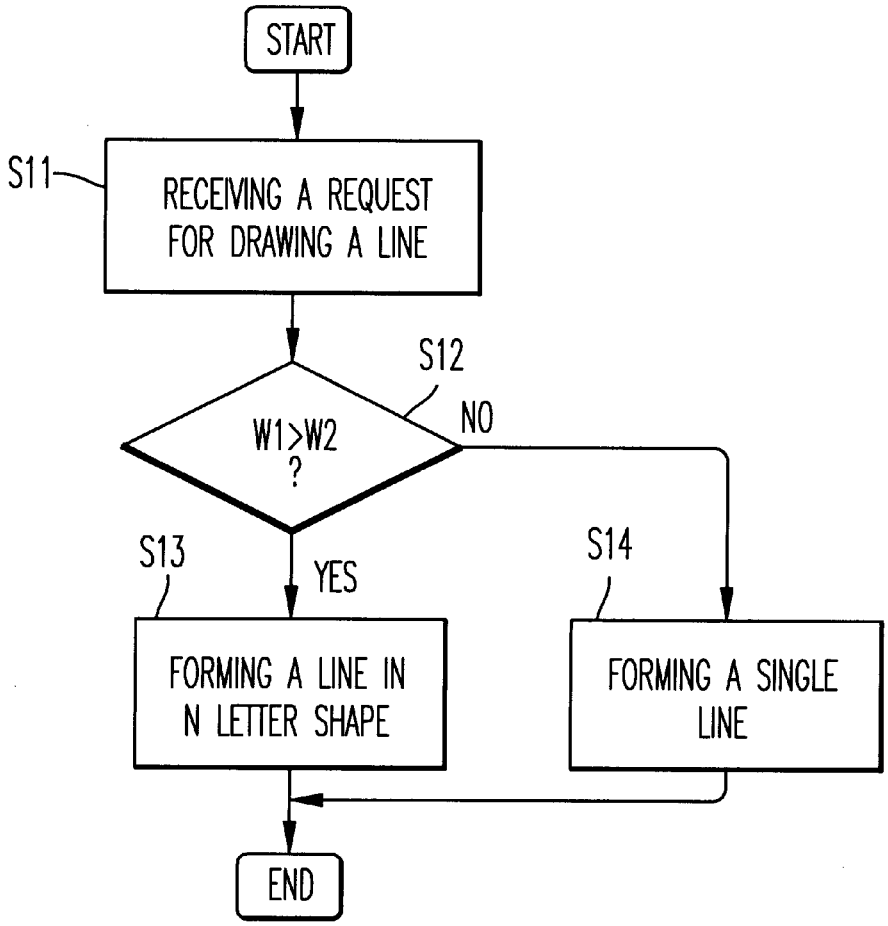
FIG. 5 shows a further control operation of the braille forming apparatus of the present invention.

A control of forming a wide line as in the present invention is shown in FIG. 5, and is similar to the control operation for forming the large size pattern as in FIG. 3.

In this control operation as shown in FIG. 5, in a step S11 a request for drawing a line of width W1 is received at CPU 13. Memory 12 stores a value W2 which indicates a reference width of a line for which a special wide line forming operation is to be implemented. This value W2 may, as an example, be equal to the width of the pen 3. If the width W1 of the requested line does not exceed this reference value W2, i.e., NO in step S12, then the system forms a conventional single line in step S14.

However, if the width W1 of the requested line exceeds the reference value W2 indicating that a wide line is desired to be formed, i.e., YES in step S12, then the system proceeds to step S13 in which a special pattern of moving the pen 3 is implemented to form such a wide line.

Figure 6:
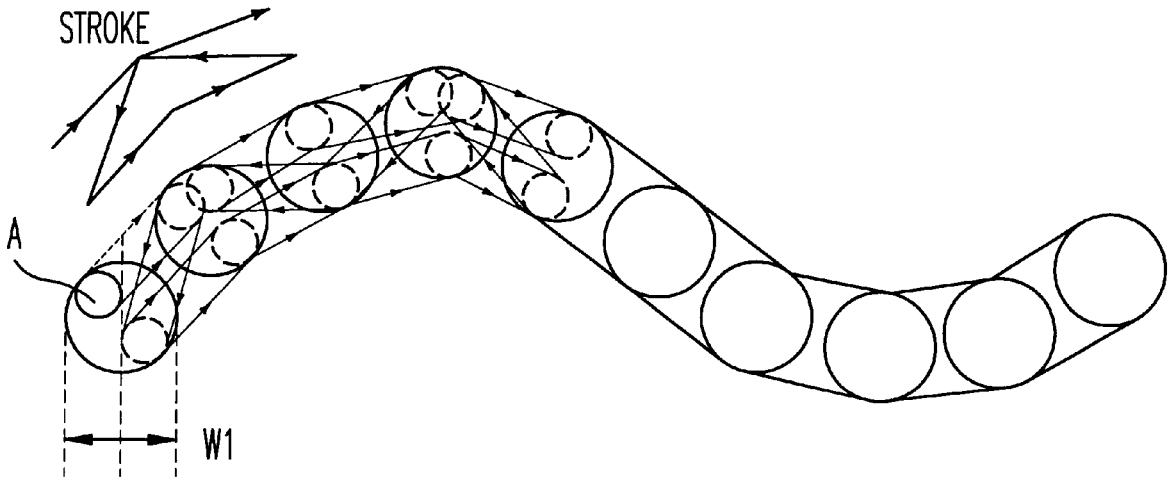
FIG. 6 shows a further control operation of the braille forming apparatus of the present invention.

FIG. 6 shows one implementation of such a specialized pattern as in the present invention. As shown in FIG. 6, if a wide line is desired to be formed in the present invention, the pen 3 follows through a stroke of a repeated N pattern, in which the pen 3 is not required to be lifted from the braille sheet S. As shown in FIG. 6, a line of width W1 can be formed by moving the pen 3 in a zig zag N pattern which is repeated through the length of the wide line. This pattern shown in FIG. 6 repeats an N letter shape in a zig zag pattern, although the direction changes of such a pattern can be smoothed out so that the pattern is more in a smoothed S letter shape.

Forming a wide line with such a pattern as shown in FIG. 6 can provide for a line of a wider width W1. However, forming a wide line with such a pattern as shown in FIG. 6 is somewhat time consuming.

Figure 7:
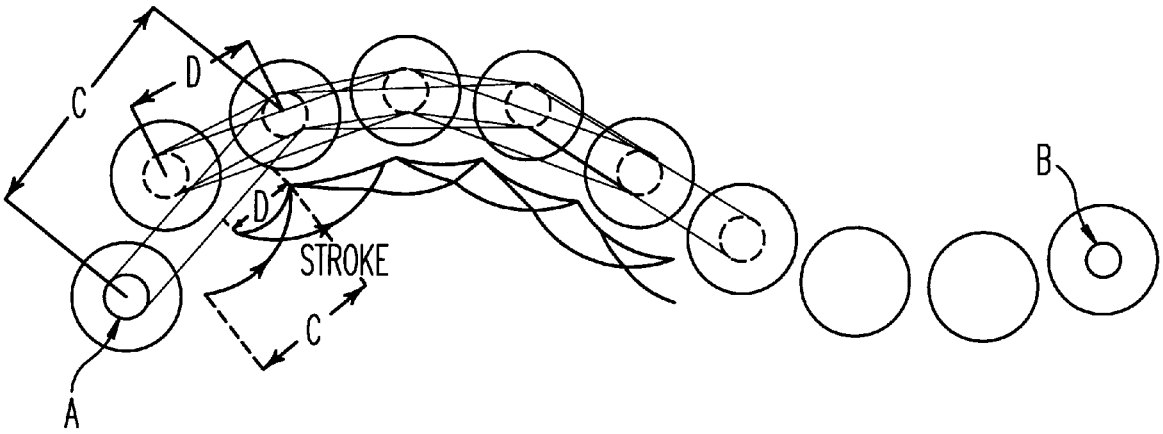
FIG. 7 shows a further control operation of the braille forming apparatus of the present invention.

FIG. 7 of the present invention shows a further pattern which can be implemented in forming a wide line. The pattern of FIG. 7 moves the pen 3 through a stroke of a zig zag locus.

The advantage of forming a wide line with the pattern shown in FIG. 7 is that a speed for forming the wide line can be increased as the pattern shown in FIG. 7 requires less movement of the pen 3 compared with the pattern shown in FIG. 6. However, the drawback with forming a wide line with the pattern shown in FIG. 7 is that the pattern shown in FIG. 7 cannot form lines with as great a width as the system shown in FIG. 6.

One implementation of an operation of the present invention is to allow a braille forming apparatus to form wide line by selectively using the patterns shown in either of FIGS. 6 or 7.

One way in which both the patterns of FIGS. 6 and FIG. 7 can be implemented in the present invention is to utilize the pattern of FIG. 7 for forming lines having an intermediate width, and to utilize the pattern of FIG. 6 for forming lines having a greater width. That is, as discussed above the operation of FIG. 7 is not as effective in forming very wide lines as the operation of FIG. 6. Therefore, one implementation of the system of the present invention is to form intermediate width lines with the operation of FIG. 7 and to form wider lines with the operation of FIG. 6. A control operation can be implemented as shown for example in FIG. 8(*a*) to achieve this operation.

Figure 8A:
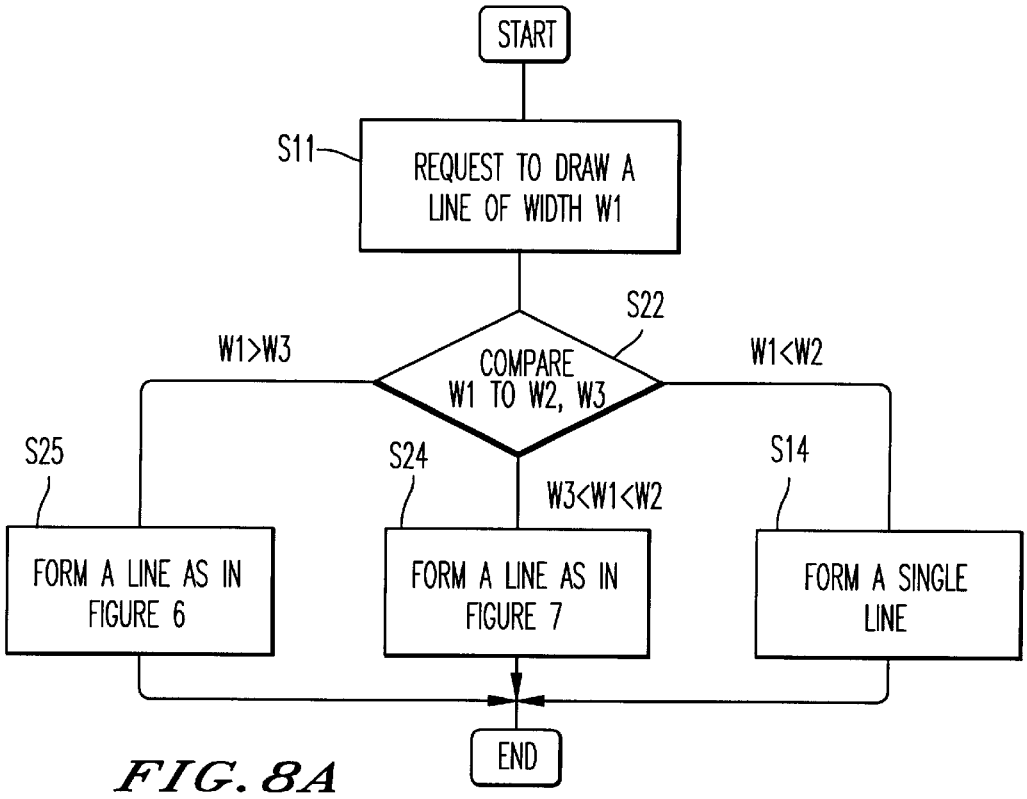
FIGS. 8(*a*) and 8(*b*) show further control operations of the braille forming apparatus of the present invention.
Figure 8B:
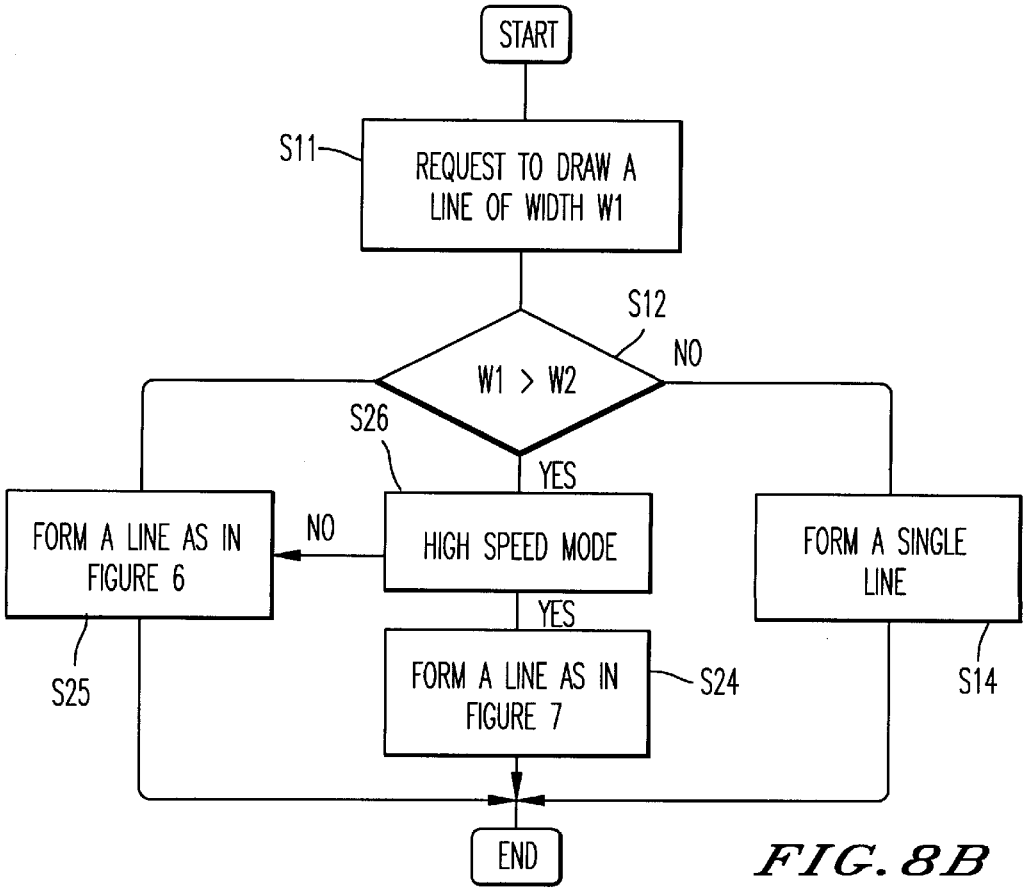

As shown in FIG. 8(*a*), in a first step S11 a request to draw a line of width W1 is received, as in the operation of FIG. 5. If this width W1 is less than W2, a single line is formed in step S14 by a conventional method. This operation of the present invention is the same as in FIG. 5 which is executed when the result of step S12 is that W1 is less than W2.

In this operation as shown in FIG. 8(*a*), however, in a step S22 the requested width of the line W1 is compared to two values W2 and W3. The value W3 is selected as a value for which the wide line forming pattern of FIG. 7 can adequately form a wide line. That is, the stored reference value W3 corresponds essentially to an intermediate line width which can be adequately formed by the pattern of FIG. 7. If it is determined in step S22 that the requested width W1 of the line is less than this value W3, the system proceeds to step S24 in which the wide line is formed by the pattern of FIG. 7. If it is determined in step S22 that the requested width W1 of the wide line exceeds the value W3, indicating that a very wide line is to be formed, then the system proceeds to step S25 in which a wide line is formed by the pattern of FIG. 6.

One other way in which a system can utilize forming a wide line from the patterns shown in FIGS. 6 and 7 in conjunction is to form a wide line with the system of FIG. 7 in a high speed mode, as shown in FIG. 8(*b*). This control operation as shown in FIG. 8(*b*) again receives a request to draw a line of a width W1 in a step S11 and compares this requested width W1 with the stored referenced value W2 in a step S12, as in the control operation of FIG. 5. If this requested width W1 is less than W2, a single line is formed in step S14, again as discussed above in the control operation of FIG. 5. If this requested width W1 is greater than W2, i.e., YES in step S12, the operation then proceeds to a step S26 to determine whether a high speed mode has been selected. That is, in a step S26 it is determined if a high speed mode of printing is desired, for example in a test mode or if a draft of a braille document is to be produced. If YES in step S26, indicating that a high speed print mode is to be executed, a wide line is formed with the system of FIG. 7 in a step S24. This control operation of FIG. 8(*b*) also has an operation in which if a low speed or high quality mode is desired, i.e. NO in step S26, a wide line can be formed by utilizing the pattern of FIG. 6 in a step S25.

The advantages of such operations in the present invention as shown in FIGS. 8(*a*) and 8(*b*) is that an appropriate pattern can be implemented based on a requested width W1 of a line and a requested printing operation.

In this way, the system of the present invention as described above provides advantages that a very large pattern can be adequately formed, and that a wide line can be easily and adequately formed.

Obviously, numerous additional modifications and variations of the present invention are possible in light of the above teachings. It is therefore to be understood that within the scope of the appended claims, the present invention may be practiced otherwise than as specifically described herein.

The present application is based on Japanese Priority document 1996-209,299, which is incorporated herein by reference.

What is claimed as new and is desired to be secured by Letters Patent of the United States is:

1. A braille forming method for forming a desired braille pattern on a sheet by contacting a pen tip against the sheet, comprising the steps of:

determining if the desired braille pattern exceeds a first predetermined size;

forming the desired braille pattern with a first pattern if it is determined that the desired braille pattern does not exceed the first predetermined size; and forming the desired braille pattern with a second pattern, different from the first pattern, if it is determined that the desired braille pattern does exceed the first predetermined size.

2. The braille forming method according to claim 1, wherein the desired braille pattern is a line and the first predetermined size is a thickness of a reference line.

3. The braille forming method according to claim 2, wherein the second pattern has a stroke of an N shape.

4. The braille forming method according to claim 2, wherein the second pattern has a stroke of a zig zag locus shape.

5. The braille forming method according to claim 2, further comprising the steps of:

determining if the size of the desired braille pattern exceeds a second predetermined size which is greater than the first predetermined size; and forming the desired braille pattern with a third pattern if it is determined that the desired braille pattern does exceed the second predetermined size.

6. The braille forming method according to claim 5, wherein the second pattern has a stroke of a zig zag locus and the third pattern has a stroke of an N shape.

7. The braille forming method according to claim 1, wherein the desired braille pattern is a dot, and the predetermined size is a diameter of a reference dot.

8. The braille forming method according to claim 7, wherein the second pattern comprises an outer circular pattern and an inner circular pattern.

9. A braille forming system for forming a desired braille pattern on a sheet by contacting a pen tip against the sheet, comprising:

means for determining if the desired braille pattern exceeds a first predetermined size;

means for forming the desired braille pattern with a first pattern if it is determined that the desired braille pattern does not exceed the first predetermined size; and means for forming the desired braille pattern with a second pattern, different from the first pattern, if it is determined that the desired braille pattern does exceed the first predetermined size.

10. The braille forming system according to claim 9, wherein the desired braille pattern is a line and the first predetermined size is a thickness of a reference line.

11. The braille forming system according to claim 10, wherein the second pattern has a stroke of an N shape.

12. The braille forming system according to claim 10, wherein the second pattern has a stroke of a zig zag locus shape.

13. The braille forming system according to claim 10, further comprising:

means for determining if the size of the desired braille pattern exceeds a second predetermined size which is greater than the first predetermined size; and means for forming the desired braille pattern with a third pattern if it is determined that the desired braille pattern does exceed the second predetermined size.

14. The braille forming system according to claim 13, wherein the second pattern has a stroke of a zig zag locus and the third pattern has a stroke of an N shape.

15. The braille forming system according to claim 9, wherein the desired braille pattern is a dot, and the predetermined size is a diameter of a reference dot.

16. The braille forming system according to claim 15, wherein the second pattern comprises an outer circular pattern and an inner circular pattern.

17. A braille forming system for forming a desired braille pattern on a sheet by contacting a pen tip against the sheet, comprising:

a controller for determining if the desired braille pattern exceeds a first predetermined size;

a braille writer forming the desired braille pattern with a first pattern if it is determined that the desired braille pattern does not exceed the first predetermined size and forming the desired braille pattern with a second pattern, different from the first pattern, if it is determined that the desired braille pattern does exceed the first predetermined size.

18. The braille forming system according to claim 17, wherein the desired braille pattern is a line and the first predetermined size is a thickness of a reference line.

19. The braille forming system according to claim 18, wherein the second pattern has a stroke of an N shape.

20. The braille forming system according to claim 18, wherein the second pattern has a stroke of a zig zag locus shape.

21. The braille forming system according to claim 18, wherein the controller further determines if the size of the desired braille pattern exceeds a second predetermined size which is greater than the first predetermined size; and the braille writer forms the desired braille pattern with a third pattern if it is determined that the desired braille pattern does exceed the second predetermined size.

22. The braille forming system according to claim 21, wherein the second pattern has a stroke of a zig zag locus and the third pattern has a stroke of an N shape.

23. The braille forming system according to claim 17, wherein the desired braille pattern is a dot, and the predetermined size is a diameter of the dot.

24. The braille forming system according to claim 23, wherein the second pattern comprises an outer circular braille pattern and an inner circular pattern.

* * * * *